US007421744B1

(12) United States Patent
Farrell

(10) Patent No.: US 7,421,744 B1
(45) Date of Patent: Sep. 9, 2008

(54) MOTORCYCLE HELMET WITH INTEGRATED ACOUSTIC VOICE AMPLIFIED CHAMBERS

(76) Inventor: John William Farrell, 132 Silas Carter Rd., Manorville, NY (US) 11949

( * ) Notice: Subject to any disclaimer, the term of this patent is extended or adjusted under 35 U.S.C. 154(b) by 0 days.

(21) Appl. No.: 11/683,358

(22) Filed: Mar. 7, 2007

(51) Int. Cl.
*A42B 3/00* (2006.01)

(52) U.S. Cl. ..... 2/423; 2/424

(58) Field of Classification Search ..... 2/410, 2/422–425, 411, 414
See application file for complete search history.

(56) References Cited

U.S. PATENT DOCUMENTS 3,693,748 A 9/1972 Jones et al.
4,054,953 A * 10/1977 De Barsy ..... 2/414
4,090,042 A 5/1978 Larkin
4,370,758 A * 2/1983 Mattheis ..... 2/423
4,555,816 A * 12/1985 Broersma ..... 2/425
4,627,115 A * 12/1986 Broersma ..... 2/425
4,704,746 A * 11/1987 Nava ..... 2/424
4,977,975 A 12/1990 Lazzeroni et al.
4,979,586 A 12/1990 Lazzeroni et al.
5,361,419 A 11/1994 Bernstein
5,632,048 A 5/1997 Mortell et al.
5,691,514 A 11/1997 Landis
5,696,356 A * 12/1997 Dudley et al. ..... 2/423

* cited by examiner

*Primary Examiner*—Danny Worrell
(74) *Attorney, Agent, or Firm*—Anthony R. Barkume

(57) ABSTRACT

A helmet having an outer shell formed to substantially enclose the head of a wearer and an inner liner disposed within the outer shell and conforming in shape substantially to the outer shell. An aperture is disposed at a front portion of the inner liner. A first exit port is disposed at a first rear portion of the outer shell, with the first exit port being substantially larger than the aperture. A first acoustic chamber is disposed between the inner liner and the outer shell and extends in a curved fashion from the aperture to the first exit port along a first side of the helmet. As a result, a wearer of the helmet is able to speak into the aperture of the helmet and have his voice carried through the first acoustic chamber and exit via the exit port to be heard by a person behind the wearer. Optionally, a second acoustic chamber is similarly disposed on the opposite side of the first acoustic chamber.

8 Claims, 6 Drawing Sheets

MOTORCYCLE HELMET WITH INTEGRATED ACOUSTIC VOICE AMPLIFIED CHAMBERS

TECHNICAL FIELD

This invention relates to helmets such as motorcycle, ATV's and snowmobile helmets (hereafter referred to as helmets) and the like, and in particular to acoustic voice chamber(s) integrated within the helmet that enable the driver to easily communicate with a rider seated behind the driver.

BACKGROUND ART

Motorcycle drivers and riders often seek to communicate with each other while riding the motorcycle. Due to the high noise levels from the motorcycle, wind and other surroundings, it is difficult for the driver to speak clearly to a rider who is sitting directly behind him. He must turn his head to speak to the rider, which creates an unsafe condition, and to speak with great exertion. It is therefore desired to provide a helmet for motorcyclists that enable the driver's voice to be projected loud and clear to the rider and have the rider hear the driver despite a high level of outside noise.

DISCLOSURE OF THE INVENTION

The present invention is a helmet such as a motorcycle helmet that has an outer shell formed to substantially enclose the head of a wearer and an inner liner disposed within the outer shell and conforming in shape substantially to the outer shell. An aperture is disposed at a front portion of the inner liner. A first exit port is disposed at a first rear portion of the outer shell, with the first exit port being substantially larger than the aperture. A first acoustic chamber is disposed between the inner liner and the outer shell and extends in a curved fashion from the aperture to the first exit port along a first side of the helmet. As a result, a wearer of the helmet is able to speak into the aperture of the helmet and have his voice carried through the first acoustic chamber and exit via the first exit port to be heard by a person behind the wearer.

The first acoustic chamber preferably has a generally oblong cross-section with a circumference gradually increasing from a first front portion near the aperture to a first rear portion near the first exit port, in a manner similar to a megaphone. By channeling the sound through this expanding cross-section, the compression waves that must carry the sound are restricted in path and are provided with an enlarging planar wave front diameter. By the time the wave front is enlarged to the opening size of the exit port, a strong directional element is achieved, enabling a projection area of an enlarging wedge, rather than the conventional omnidirectional propagation pattern. The walls of the voice channel restrict the spread of sound waves and force them to expand at an exponential rate and in a particular direction. The megaphone-like properties of this voice channel control their expansion; forcing two sound pressure molecules to move four which move eight which excite sixteen, and so on. Thus, the voice exits rearward at a higher volume, due to the efficient coupling of the rider's voice (sound waves) to the area behind the helmet.

The helmet preferably also has a second exit port disposed at a second rear portion of the outer shell, with the second exit port being substantially larger than the aperture, and a second acoustic chamber disposed between the inner liner and the outer shell and extending in a curved fashion from the aperture to the second exit port along a second side of the helmet opposite to the first side of the helmet. In the same manner as the first acoustic chamber, the second acoustic chamber has a generally oblong cross-section with a circumference gradually increasing from a second front portion near the aperture to a second rear portion near the second exit port.

Additionally, the helmet may also have a soft flexible mouthpiece extending from the aperture to enable the wearer to speak directly into the aperture without significant loss of sound pressure. The mouthpiece is preferably soft to provide enhanced safety to the wearer.

The helmet may preferably have a filler material, which is usually (but not necessarily) polystyrene, disposed between the outer shell and the inner liner, wherein the first acoustic chamber (and optional second acoustic chamber) is formed from a void in the filler material strategically located between the outer shell and the inner liner.

BEST MODE FOR CARRYING OUT THE INVENTION

Figure 1:
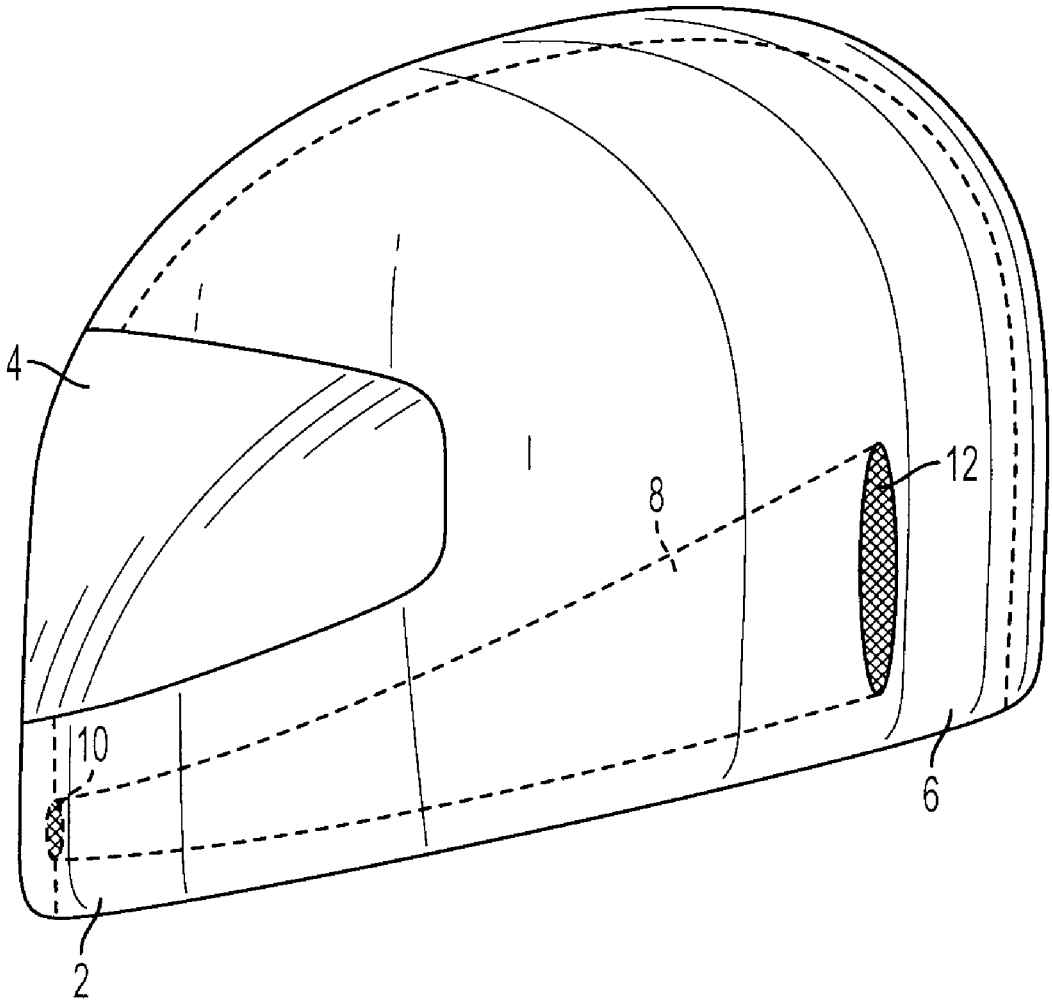
FIG. 1 is a side view of a helmet of the preferred embodiment of the present invention.

The preferred embodiments of the present invention will now be described with respect to the Figures. FIG. 1 illustrates a side view of a preferred embodiment helmet, which is a motorcycle helmet 2. The helmet 2 has an outer shell 6 formed to substantially enclose the head of a wearer (not shown) as known in the art. A face shield 4 is typically provided as known in the art. The helmet 2 also has an inner liner 24 (see FIG. 2) disposed within the outer shell 6, which conforms in shape substantially to the outer shell. Typically, the helmet may have a filler material disposed between the outer shell 6 and the inner liner 24, which may provide shock absorbing qualities as desired.

In accordance with the preferred embodiment of the present invention, two independent acoustic chambers 8, are provided to enable the wearer's voice waves to be directed and focused from the front of the motorcycle helmet (near the wearer's mouth) towards the rear and out into the space directly behind the wearer. This enables a rider who is situated behind the driver to be able to easily hear the voice of the driver when he is speaking without requiring sophisticated electronic aids as may have been done in the past. This will also allow the driver to speak with less force (sound pressure) and exertion, to achieve the same effective loudness to passenger, versus the previous misdirected and muffled sound from helmet enclosure, thus saving his/her voice from getting sore on long trips.

An aperture 10 is provided at a front portion of the inner liner 24 of the helmet 2. This may simply be a hole cut into the liner 24 to enable the wearer to speak into it. A first exit port 12 is disposed at a first rear portion of the outer shell 6, with the first exit port 12 being substantially larger than the aperture 10. A first acoustic chamber 8 is thusly disposed between the inner liner 24 and the outer shell 6 and extends in a curved fashion from the aperture 10 to the first exit port 12 along a first side of the helmet, which in this case is the left side of the helmet. As a result, a wearer of the helmet is able to speak into the aperture 10 and have his voice carried through the first acoustic chamber 8 and exit via the first exit port 12 to be heard by a person situated behind the wearer.

As can be seen in the FIGS. 1-5, the first acoustic chamber 8 preferably has a generally oblong cross-section with a circumference gradually increasing from a first front portion near the aperture 10 to a first rear portion near the first exit port. This provides a megaphone-like shape, which will tend to enhance the sound waves emanating from the wearer of the helmet towards the rider behind the helmet. This is the preferred (but not required) shape of the acoustic chamber(s) since the megaphone shape will tend to concentrate the voice in the desired direction.

Although the present invention will operate successfully with a single acoustic chamber, which may be on the left side or the right side of the helmet 2 as desired, the acoustic transfer qualities of this invention will benefit from having a pair of oppositely disposed acoustic chambers, which are shown in the Figures as the first acoustic chamber 8 (described above) and a second acoustic chamber 20. In this embodiment, the helmet 2 also has a second exit port 22 disposed at a second rear portion of the outer shell 6, with the second exit port 22 being substantially larger than the aperture 10 in the same manner as is the first exit port 12. Similarly, the second acoustic chamber 20 is disposed between the inner liner 24 and the outer shell 6 and extends in a curved fashion from the aperture 10 to the second exit port 22 along a second side of the helmet opposite to the first side of the helmet (i.e. the right side). In the same manner as the first acoustic chamber 8, the second acoustic chamber 20 has a generally oblong cross-section with a circumference gradually increasing from a second front portion near the aperture 10 to a second rear portion near the second exit port 22.

In this embodiment, the wearer's voice will be enter the aperture 10 and be carried by both acoustic chambers 8, towards the rider behind the wearer.

Figure 4:
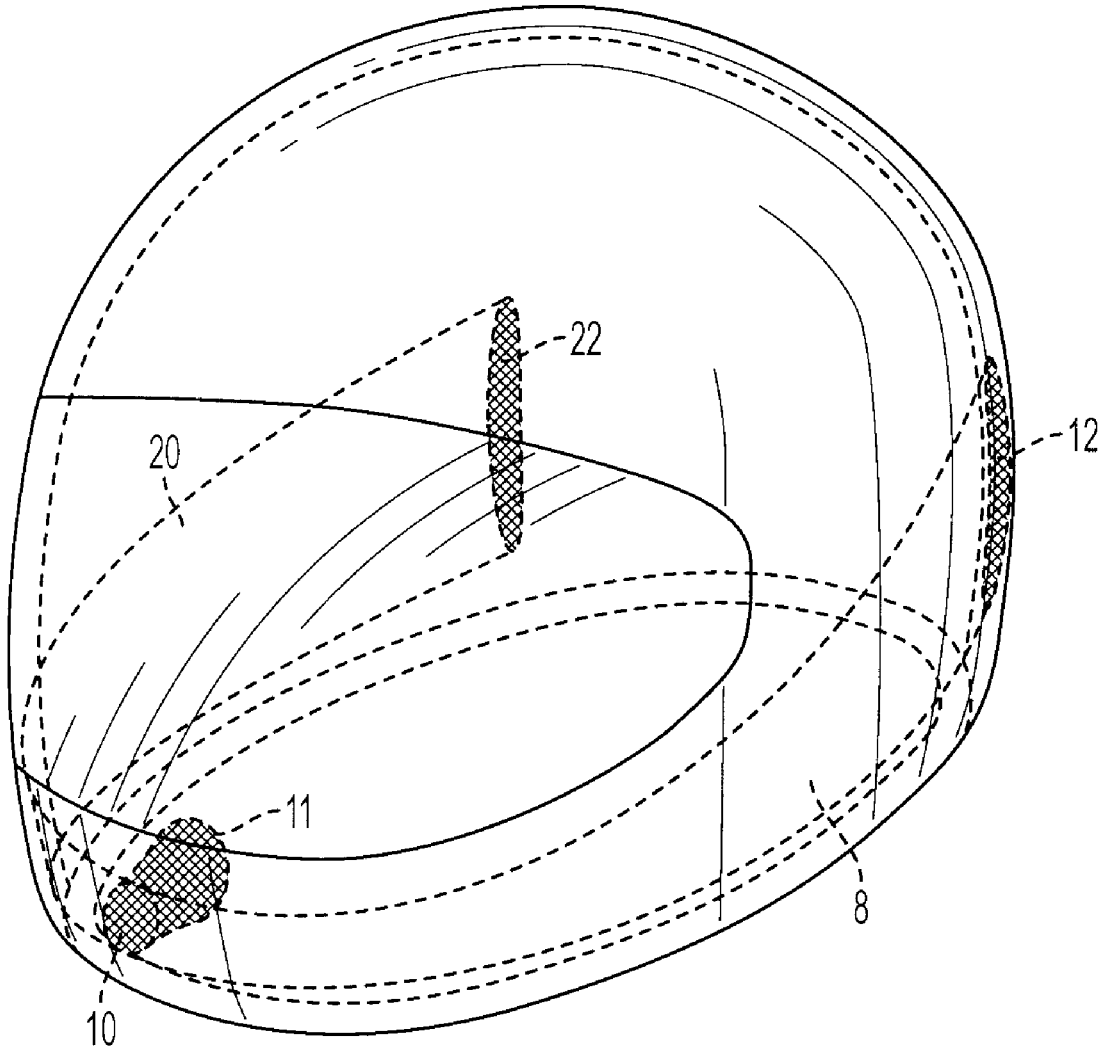
FIG. 4 is a front perspective view of the helmet of the preferred embodiment of the present invention.
Figure 5:
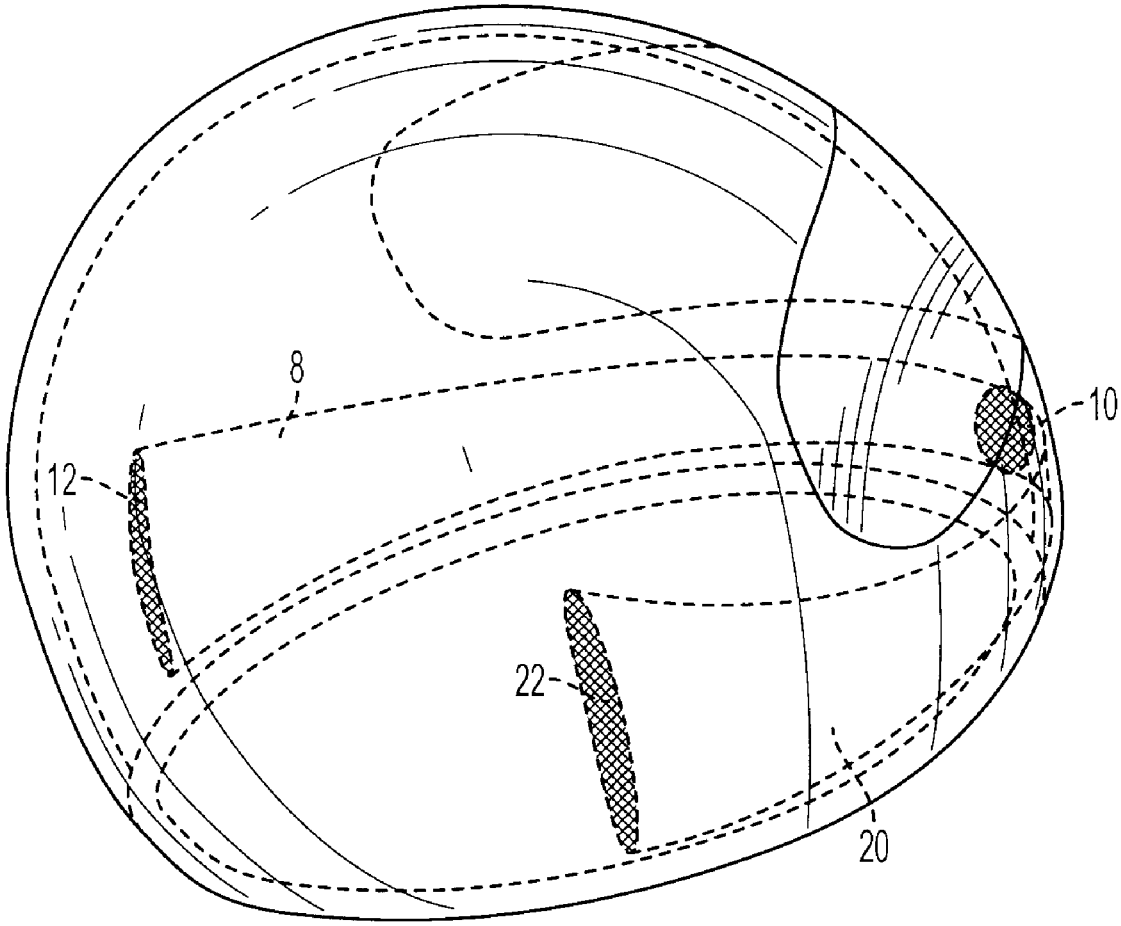
FIG. 5 is a side perspective view of the helmet of the preferred embodiment of the present invention.

Optionally, the helmet 2 may also have a flexible mouthpiece 11 as shown in FIG. 4, which extends from the aperture 10 to enable the wearer to speak directly into the aperture without significant loss of sound pressure. The wearer may grip the mouthpiece 11 with his lips and/or teeth, or he may simply place his mouth near the outside of the mouthpiece 11, as desired.

As described above, the helmet may have a filler material disposed between the outer shell and the inner liner as known in the art. The acoustic chambers 8, 20 may be formed from a void in the filler material strategically located between the outer shell and the inner liner. That is, by hollowing out or otherwise providing a void in the desired megaphone-like shape as described, the acoustic chambers are formed between the outer shell 6 and the inner liner 24. In the alternative, structures may be formed from other materials (e.g. plastics) that provide the desired megaphone shaped acoustic chamber(s), and then placed within the space between the outer shell 6 and the inner liner 24 as described.

Figure 2:
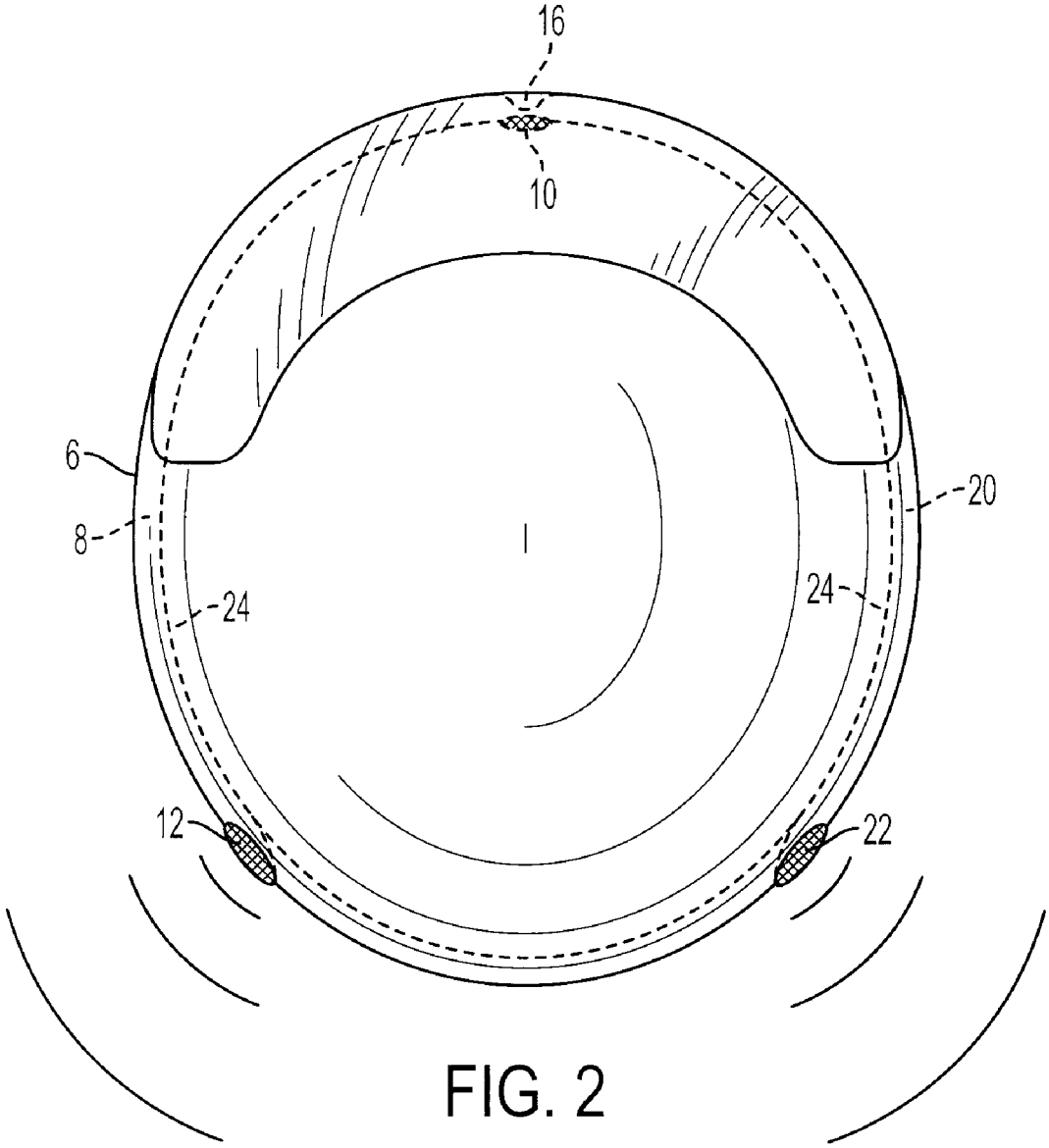
FIG. 2 is a top view of the helmet of the preferred embodiment of the present invention.
Figure 3:
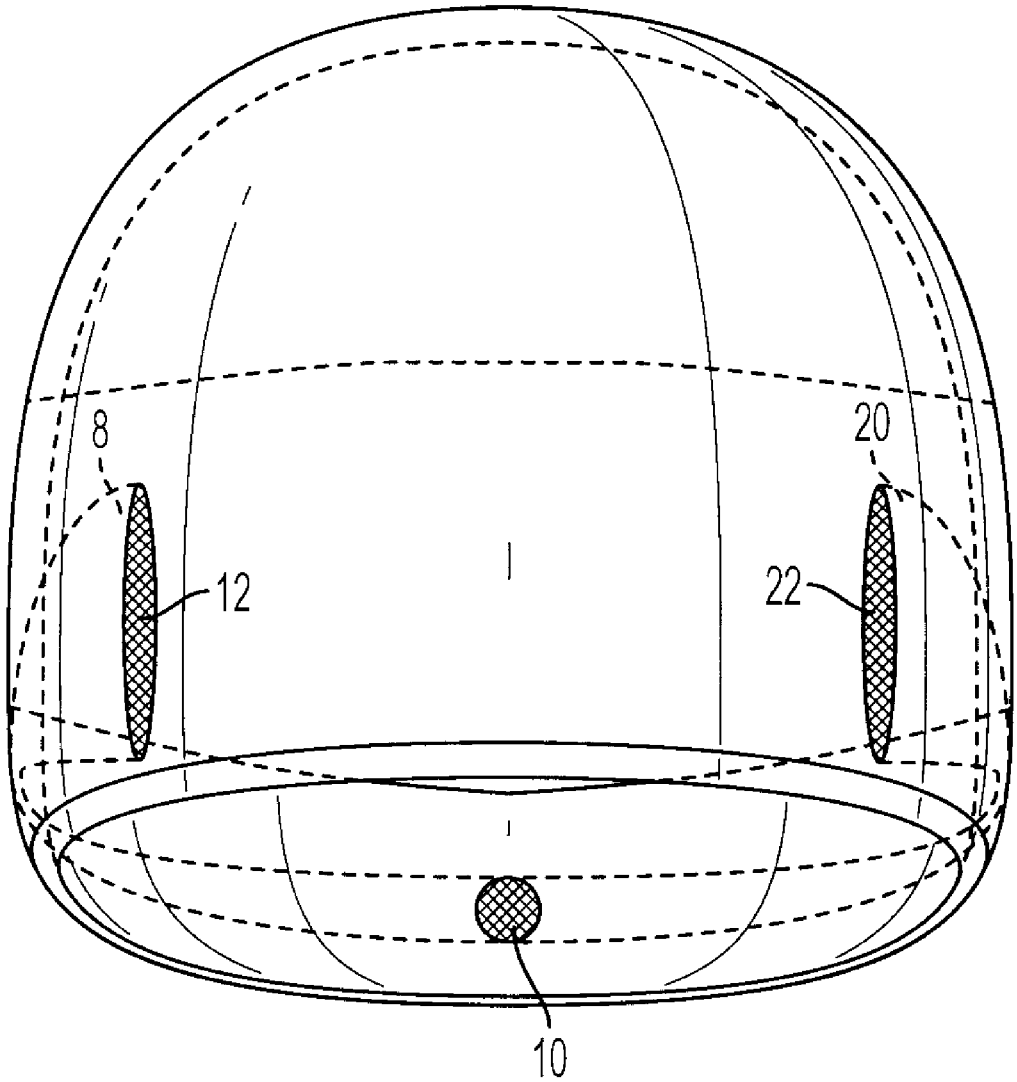
FIG. 3 is a rear view of the helmet of the preferred embodiment of the present invention.

Shown in FIG. 2 is a deflector 16 which is located on the inside portion of the outer shell 6, just near the aperture 10. The deflector 16 will help urge sound waves emanating from the wearer towards either or both of the acoustic chambers, thus aiding in sound transmission to the rear of the helmet. This deflector also fills the increased volumetric void at this junction point, and is shaped to create a smoother transitional cross sectional path to the channels.

As a result, the helmet 2 is provided with voice-carrying acoustic chambers that extend from the front of the helmet towards and out the rear of the helmet. These acoustic chambers are integral with the helmet and need not be carried about as separate pieces requiring attachment. Because these acoustic chambers are integral to and within the interior space of the helmet, they are unobtrusive to the wearer and are not readily seen by anyone else. This results in a design that does not detract from the appeal of the design of the helmet.

Figure 6:
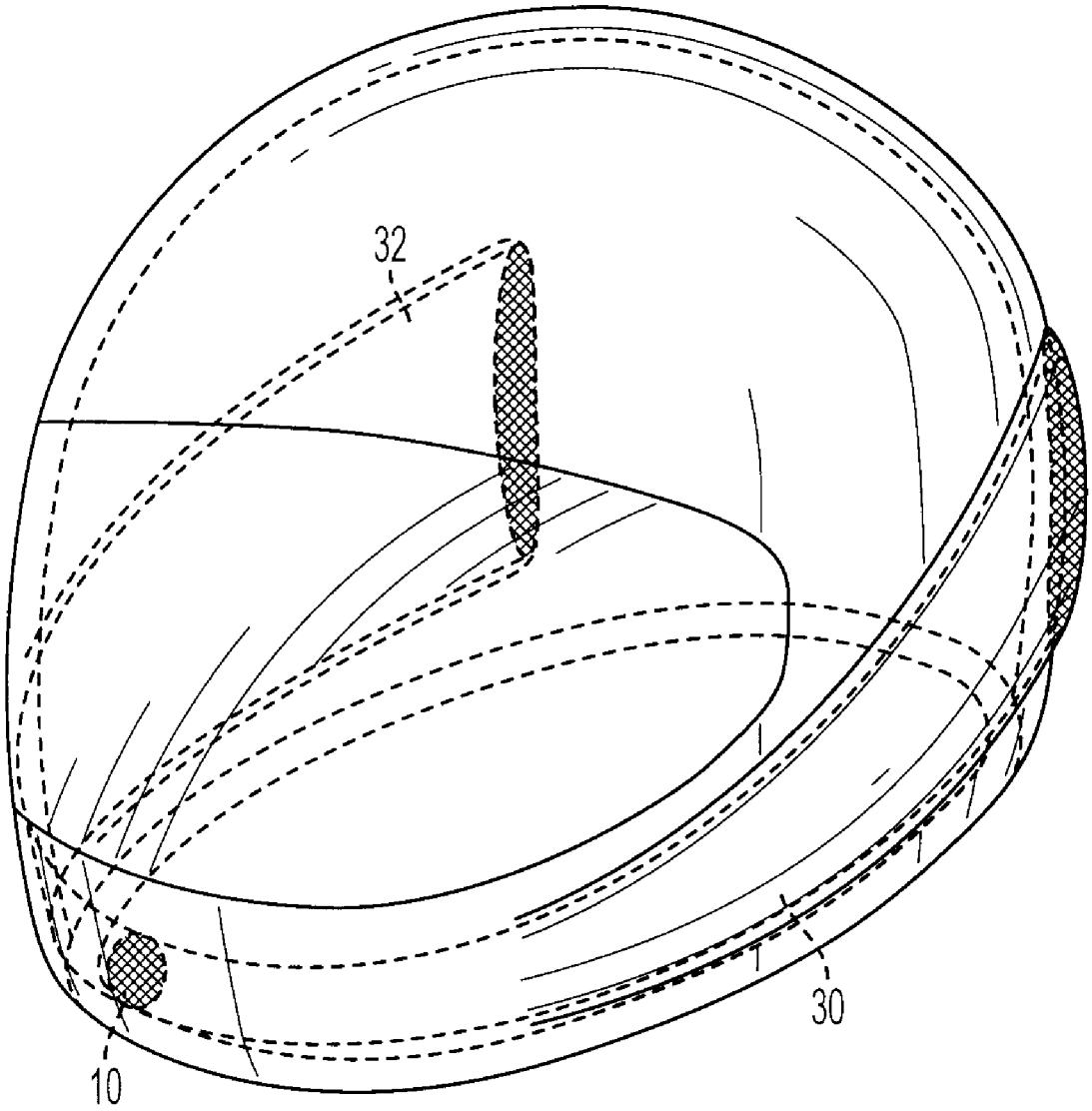
FIG. 6 is a front perspective view of the helmet of an alternative embodiment of the present invention.

In an alternative embodiment, the outer shell may be modified to provide bumped out portions 30 and 32 as shown in FIG. 6. The acoustic chambers may be made somewhat larger in this embodiment since more room can be allocated due to the bumped out portions, rather than requiring smooth contours as in the preferred embodiment shown in FIGS. 1-5 above.

It will be apparent to those skilled in the art that modifications to the specific embodiment described herein may be made while still being within the spirit and scope of the present invention

What is claimed is:

1. A helmet comprising:

a) an outer shell formed to substantially enclose the head of a wearer;

b) an inner liner disposed within the outer shell and conforming in shape substantially to the outer shell;

c) an aperture disposed at a front portion of the inner liner substantially adjacent to the mouth of a wearer of the helmet;

d) a first exit port disposed at a first rear portion of the outer shell, said first exit port being substantially larger than said aperture; and e) a first acoustic chamber disposed between the inner liner and the outer shell and extending in a curved fashion from the aperture to the first exit port along a first side of the helmet;

whereby a wearer of the helmet is able to speak into the aperture of the helmet and have his voice carried through the first acoustic chamber and exit via the first exit port to be heard by a person behind the wearer.

2. The helmet of claim 1 wherein said first acoustic chamber has a cross-section with an area gradually increasing from a first front portion near the aperture to a first rear portion near the first exit port.

3. The helmet of claim 2 further comprising f) a second exit port disposed at a second rear portion of the outer shell, said second exit port being substantially larger than said aperture; and g) a second acoustic chamber disposed between the inner liner and the outer shell and extending in a curved fashion from the aperture to the second exit port along a second side of the helmet opposite the first side of the helmet.

4. The helmet of claim 3 wherein said second acoustic chamber has a cross-section with an area gradually increasing from a second front portion near the aperture to a second rear portion near the second exit port.

5. The helmet of claim 1 further comprising a mouthpiece extending from the aperture.

6. The helmet of claim 1 wherein the helmet is a motorcycle helmet.

7. The helmet of claim 1 further comprising filler material disposed between the outer shell and the inner liner, wherein the first acoustic chamber is a void in the filler material strategically located between the outer shell and the inner liner.

8. The helmet of claim 3 further comprising a deflector disposed inside the outer shell in relation to the aperture so as to deflect sound waves emanating through the aperture towards each of the first and second acoustic chambers.

* * * * *